United States Patent [19]

Howard et al.

[11] 4,392,945

[45] Jul. 12, 1983

[54] TWO-STAGE HYDROREFINING PROCESS

[75] Inventors: Kent A. Howard; Duane A. Goetsch, both of Baton Rouge, La.

[73] Assignee: Exxon Research and Engineering Co., Florham Park, N.J.

[21] Appl. No.: 346,173

[22] Filed: Feb. 5, 1982

[51] Int. Cl.[3] ..... C10G 45/06; C10G 45/08

[52] U.S. Cl. ..... 208/210; 208/217

[58] Field of Search ..... 208/210, 217, 254 H

[56] References Cited

U.S. PATENT DOCUMENTS

| | | | |
|---|---|---|---|
| 3,190,830 | 6/1965 | Rowland et al. | 208/255 |
| 3,349,027 | 10/1967 | Carr et al. | 208/210 |
| 3,642,927 | 2/1972 | Kovach et al. | 208/216 R |
| 3,717,571 | 2/1973 | Schulman | 208/254 H |
| 3,761,399 | 9/1973 | McKinney et al. | 208/210 |
| 3,847,799 | 11/1974 | Munro | 208/210 |
| 3,968,027 | 7/1976 | Frayer et al. | 208/210 |
| 4,016,069 | 4/1977 | Christman et al. | 208/210 |
| 4,048,060 | 9/1977 | Riley | 208/210 |

*Primary Examiner*—Delbert E. Gantz
*Assistant Examiner*—O. Chaudhuri
*Attorney, Agent, or Firm*—Marthe L. Gibbons

[57] ABSTRACT

A heavy hydrocarbonaceous oil containing certain types of organic sulfur compounds, such as, dibenzothiophenes, is hydrorefined in two stages with interstage removal of hydrogen sulfide and ammonia. A nickel-containing hydrorefining catalyst is used in the first hydrorefining stage and a cobalt-containing hydrorefining catalyst is used in the second hydrorefining stage.

11 Claims, 1 Drawing Figure

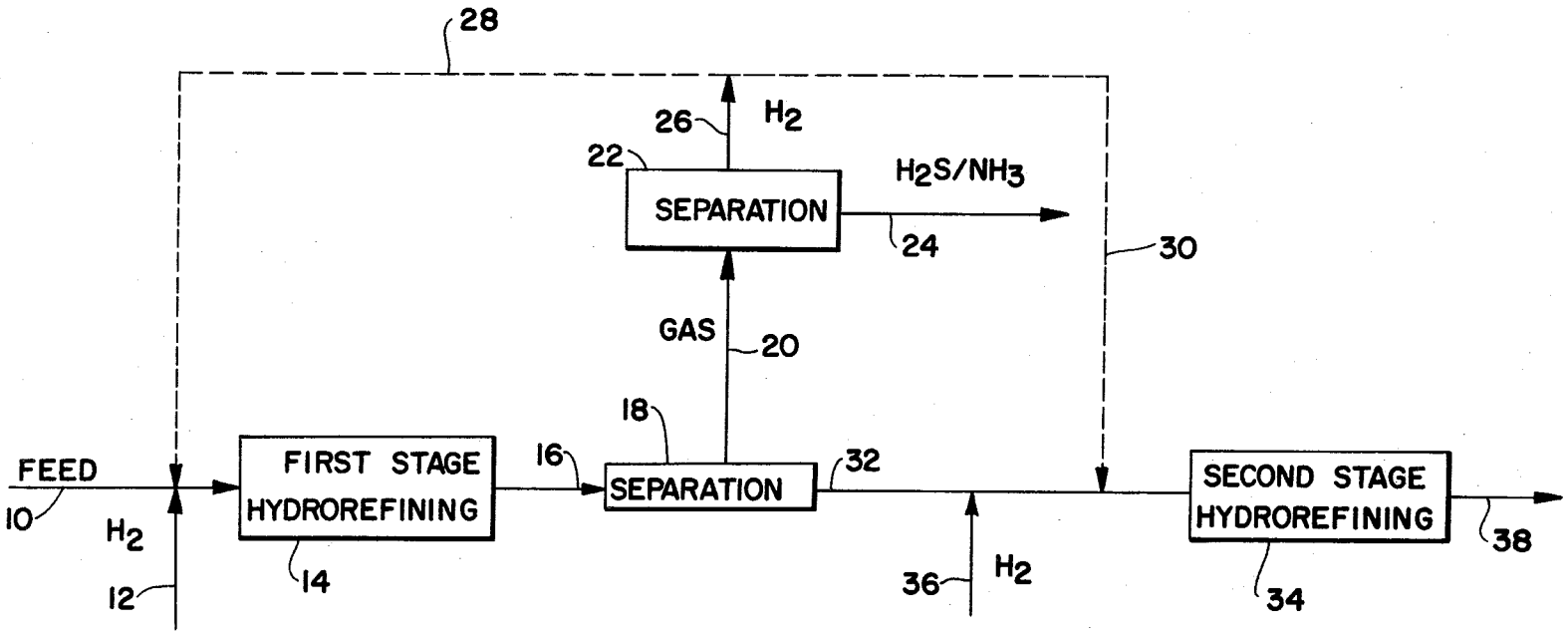
FEED
10
$H_2$
12
FIRST STAGE HYDROREFINING
14
16
SEPARATION
18
GAS
20
SEPARATION
22
$H_2$
26
$H_2S/NH_3$
24
28
30
32
$H_2$
36
SECOND STAGE HYDROREFINING
34
38

TWO-STAGE HYDROREFINING PROCESS

BACKGROUND OF THE INVENTION

1. Field of the Invention

This invention relates to a two-stage hydrorefining process for heavy hydrocarbonaceous oils.

2. Description of the Prior Art

Hydrorefining is a well known process for upgrading hydrocarbonaceous oils by contacting the oils with added hydrogen in the presence of a catalyst to eliminate or reduce the concentration of contaminants in the oil such as sulfur compounds, nitrogenous compounds, and metal contaminants and/or partial saturation of the oil.

Multistage hydrodesulfurization processes are known in which the hydrogen sulfide and ammonia are removed between stages. See, for example, U.S. Pat. No. 3,717,571, and 3,847,799.

U.S. Pat. No. 4,048,060 discloses a two-stage hydrodesulfurization process in which a first stage catalyst and a second stage catalyst comprise Group VIB and Group VIII metal components. Hydrogen sulfide produced in the first hydrotreating zone may be removed between stages (see column 5, line 22).

It has now been found that for hydrorefining heavy hydrocarbonaceous oils containing certain types of organic sulfur compounds, a two-stage process utilizing a specific sequence of catalysts with interstage removal of hydrogen sulfide and ammonia will provide advantages that will become apparent in the ensuing description.

SUMMARY OF THE INVENTION

In accordance with the invention there is provided a two-stage hydrorefining process which comprises: (a) contacting a heavy hydrocarbonaceous oil comprising an organic sulfur compound selected from the group consisting of dibenzothiophene, dibenzothiophene derivatives, substituted dibenzothiophene and mixtures thereof, with hydrogen in the presence of a nickel-containing hydrorefining catalyst in a first hydrorefining zone maintained at hydrorefining conditions to produce a first hydrorefining stage effluent, including a normally liquid partially desulfurized hydrocarbonaceous oil, and a normally gaseous product, including hydrogen sulfide and ammonia; (b) removing at least a portion of said hydrogen sulfide and said ammonia from said first hydrorefining stage effluent, and (c) contacting at least a portion of the resulting hydrorefining stage effluent, including said partially hydrodesulfurized oil, with hydrogen in the presence of a cobalt-containing hydrorefining catalyst in a second hydrorefining stage to produce a hydrocarbonaceous oil having a lower sulfur content than the sulfur content of the partially desulfurized oil of said first hydrorefining stage.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a heavy hydrocarbonaceous oil feed comprising sulfur compounds, including at least one organic sulfur compound selected from the group consisting of dibenzothiophene, dibenzothiophene derivatives, substituted dibenzothiophene and mixtures thereof, carried in line 10 is mixed with a hydrogen-containing gas introduced by line 12. The mixture is introduced into first hydrorefining stage 14. Suitable sulfur-containing heavy hydrocarbonaceous feeds are generally hydrocarbonaceous oils boiling above about 350° F., preferably above about 400° F., at atmospheric pressure, in which at least one of the above mentioned organic sulfur compounds is present. The process of the present invention is particularly suited for treating oils comprising dibenzothiophene with substituents on the beta carbon atom, for example, 4- and/or 6-methyl dibenzothiophene. The heavy hydrocarbonaceous oils may be derived from any sources such as petroleum, coal liquefaction processes, tar sand oils, shale oils, in which said organic sulfur compounds may be present. The sulfur content of said oils may range up to about 8 weight percent or more. The heavy oils may also contain up to about 4 weight percent or more nitrogen contaminants and may additionally contain metal contaminants. The dibenzothiophene content of the oil feed for the process of the present invention will be at least about 0.30 weight percent, preferably at least 0.75 percent, and may range from about 0.30 to about 1.50 weight percent, calculated as the dibenzothiophenic compound, based on the oil feed. Suitable dibenzothiophenic compound-containing heavy oils include petroleum derived oils such as gas oils obtained from a cracking process, for example, coker gas oil, gas oil from catalytic cracking, gas oil from steam cracking, gas oil from thermal cracking, cycle oils from catalytic cracking, etc.; residual oils such as atmospheric residua; vacuum residua; heavy oils derived from coal liquefaction processes and mixtures thereof.

A nickel-containing conventional hydrorefining catalyst is present in first hydrorefining stage 14. Suitable nickel-containing hydrorefining catalysts generally comprise a hydrogenation component such as a Group VIB and a Group VIII metal, metal oxide, metal sulfide and mixtures thereof composited with a support. Preferably the catalyst comprises a nickel component and a molybdenum component and/or a tungsten component composited with an alumina support which may additionally comprise silica and/or phosphorus. The more preferred catalyst comprises nickel and molybdenum on an alumina support which may comprise from about 1 to about 6 weight percent silica, based on the weight of the support. The Periodic Table referred to herein is givent in *Handbook of Chemistry and Physics*, published by Chemical Rubber Company, Cleveland, Ohio, 46th Edition, 1964. Suitable catalysts are described, for example, in U.S. Pat. Nos. 3,770,618; 3,509,044 and 4,113,656, the teachings of which are hereby incorporated by reference. If desired, the catalysts may be sulfided prior to use or in situ, as is well known in the art. Suitable operating conditions in the first hydrorefining stage are summarized in Table I.

TABLE I

| Conditions | Broad Range | Preferred Range |
|---|---|---|
| Temperature, °F. | 600–850 | 650–800 |
| Total pressure, psig | 60–3,500 | 800–2,500 |
| Liquid hourly space velocity, V/V/HR | 0.05–5.0 | 0.1–2.5 |
| Hydrogen rate, SCF/BBL | 300–10,000 | 2000–6,000 |
| Hydrogen partial pressure, psig | 40–3,000 | 350–2,250 |

The first stage hydrorefining reaction is conducted at conditions and for a time sufficient to produce a partially desulfurized hydrocarbonaceous oil product. Preferably, the reaction is conducted at conditions and for a time sufficient to effect at least a 50 weight percent desulfurization, of the sulfur-containing hydrocarbonaceous feed calculated as sulfur, based on the initial feed sulfur. The first hydrorefining stage effluent comprises a normally liquid phase, including a partially desulfurized hydrocarbonaceous oil, and a gaseous phase, including hydrogen sulfide, ammonia, hydrogen and $C_1$ and $C_4$ gases, etc. The first hydrorefining stage effluent is removed from hydrorefining stage 14 and passed by line 16 to separation zone 18 wherein the gaseous phase is separated from the liquid phase by methods well known in the art. The gaseous phase is removed from separation zone 18 and passed by line 20 to separation zone 22 in which hydrogen sulfide and ammonia are removed from the gaseous phase by any of the known methods. At least a portion of the hydrogen sulfide and ammonia are removed from the gaseous phase, preferably also the $C_1$ to $C_4$ gases. More preferably, substantially all of the hydrogen sulfide and ammonia and the $C_1$ to $C_4$ gases are removed from the gaseous phase by line 24. If desired, the resulting gas 26, which comprises hydrogen, and from which a hydrogen sulfide and the ammonia have been removed may be recycled to the first stage hydrorefining via line 28 or may be passed to a second stage hydrorefining by line 30. A normally liquid phase is removed from separation zone 18 and passed by line 32 to a second stage hydrorefining 34. If desired, additional fresh hydrogen-containing gas may be introduced into hydrorefining 34, for example, by mixing a fresh hydrogen-containing gas via line 36 into line 32 or the fresh hydrogen-containing gas may be introduced directly into the second stage hydrorefining zone 34.

Suitable operating conditions in the second hydrorefining stage are given in Table II.

TABLE II

| Conditions | Broad Range | Preferred Range |
|---|---|---|
| Temperature, °F. | 600–850 | 650–800 |
| Total pressure, psig | 60–3,500 | 800–2,500 |
| Liquid hourly space velocity, V/V/HR | 0.05–5.0 | 0.1–2.5 |
| Hydrogen rate, SCF/BBL | 300–10,000 | 2,000–6,000 |
| Hydrogen partial pressure, psig | 40–3,000 | 350–2,250 |

Although the first and second hydrorefining conditions fall within the same ranges, the actual conditions used in the first and second hydrorefining stages may be different.

A cobalt-containing conventional hydrorefining catalyst is present in second hydrorefining stage 34. The cobalt-containing catalyst may be any of the conventional hydrorefining catalysts provided that it comprises cobalt and no nickel, in contrast with the catalyst used in the first hydrorefining stage in which the catalyst comprises nickel and no cobalt. The cobalt-containing catalyst may also comprise a molybdenum component, a tungsten component and mixtures thereof. The preferred catalyst comprises cobalt-molybdenum on an alumina support, which may additionally contain from 1 to 6 weight percent silica, based on the weight of the support. Such catalysts are described in already mentioned U.S. Pat. Nos. 3,770,618; 3,509,044 and 4,113,656. The second stage hydrorefining reaction is conducted at conditions and for a time sufficient to desulfurize the partially desulfurized hydrocarbonaceous oil to a greater extent, preferably to achieve a desulfurization level of at least about 90 weight percent relative to the initial oil feed sulfur of the first hydrorefining stage. The effluent of the second hydrorefining stage is removed from hydrorefining stage 34 by line 38. The effluent may be separated in a conventional way into normally gaseous phase, including hydrogen, and normally liquid phase, including desulfurized hydrocarbonaceous oil. The desulfurized hydrocarbonaceous oil is recovered. The gaseous phase, after removal of hydrogen sulfide, ammonia and light gases, may be recycled either to the first hydrorefining stage or to the second hydrorefining stage or to both.

The following examples are presented to illustrate the invention.

EXAMPLE 1

To simulate a two-stage hydrorefining operation, comparative experiments were made utilizing a hydrorefining catalyst on a feed to desulfurize the feed partially and then subjecting the partially desulfurized feed to hydrorefining conditions utilizing a different catalyst.

The feed utilized in these experiments was a cracked hydrocarbonaceous oil having an atmospheric pressure boiling point ranging from about 425° to about 650° F., a sulfur content of about 1.50 weight percent, and a sulfur component composition shown in Table III.

TABLE III

| Feed A Sulfur Components | |
|---|---|
| Component | WPPM As Sulfur |
| Non-dibenzothiophene(1) | 8026 |
| Dibenzothiophene | 523 |
| Beta-substituted dibenzothiophene(2) | 3284 |
| Non-beta substituted dibenzothiophene(3) | 3165 |
| TOTAL | 15,000 |

(1)Sulfur compounds other than dibenzothiophenic compounds.
(2)Predominantly methyl substituted dibenzothiophene wherein methyl moiety is at beta carbon.
(3)Predominantly methyl substituted dibenzothiophene wherein substitution is at a carbon atom other than the beta carbon atom.

The feed, herein designated feed A, was hydrorefined in the presence of a nickel-molybdenum on alumina catalyst comprising 5.88 weight percent nickel and 27.2 weight percent molybdenum, calculated as the oxide thereof, based on the total catalyst. The hydrorefining reaction was carried out for 0.4 hour. The operating conditions of the simulated first stage hydrorefining and the results are summarized in Table IV.

TABLE IV

| | |
|---|---|
| Temperature, °F. | 625° F. |
| Total pressure, psig | 300 |
| Liquid hourly space velocity, V/V/HR | 2.5 |
| Hydrogen rate, SCF/BBL | 1000 |
| Total product sulfur, wppm | 3100 |

The hydrorefined oil of the simulated first stage hydrorefining was then hydrorefined with a cobalt-molybdenum on alumina catalyst comprising 4.5 weight percent cobalt and 18.4 weight percent molybdenum, calculated as the oxides thereof, based on the total catalyst. This catalyst is herein designated catalyst 2. The nickel-containing catalyst described above is designated catalyst 1. The operating conditions and results are summarized in Table V.

TABLE V

| | |
|---|---|
| Temperature, °F. | 625° F. |
| Total pressure, psig | 300 |
| Liquid hourly space velocity, V/V/HR | 2.5 |
| Hydrogen rate, SCF/BBL | 1000 |
| Total product sulfur, wppm | 730 |
| Non-dibenzothiophene | 62 |
| Dibenzothiophene | 0 |
| Beta-substituted dibenzothiophene | 614 |
| Non-beta substituted dibenzothiophene | 54 |

The same cracked oil feed was subjected to the same conditions as given in Table IV except that the above cobalt-molybdenum catalyst designated catalyst 2 was used to produce the partially desulfurized oil. The partially desulfurized oil was then subjected to conditions shown in Table V but utilizing the catalyst designated catalyst 1, that is, the nickel-molybdenum catalyst. The results of these experiments are summarized in Table VI.

TABLE VI

| | |
|---|---|
| Total product sulfur, wppm | 960 |
| Non-dibenzothiophene | 0 |
| Dibenzothiophene | 0 |
| Beta-substituted dibenzothiophene | 863 |
| Non-beta substituted dibenzothiophene | 97 |

As can be seen from Table VI, reversing the order of the catalysts using the same cracked oil feed and the same hydrorefining conditions did not give the same depth of desulfurization, particularly of the more difficult to remove type of organic sulfur compounds, that is, the beta-substituted dibenzothiophenes.

EXAMPLE 2

To simulate a two-stage hydrorefining operation on feeds which differ in ease of desulfurization, comparative experiments were made utilizing two hydrorefining catalysts, separately, in series and in staged configuration, as described in Example 1. From these experiments, reaction rates for component dibenzothiophenes were measured on feed A described in Example 1. Two feeds, for which dibenzothiophene compositions were measured, were used with the reaction rate data to calculate process conditions needed to achieve the same level of desulfurization. The feeds utilized for these calculations were as follows:

Feed B was a virgin feed having a boiling point ranging from about 426° to about 648° F., a sulfur content shown in Table VII. The other feed used in the calculations was feed A described in Example 1.

TABLE VII

| Feed B Sulfur Components | |
|---|---|
| Component | WPPM As Sulfur |
| Non-dibenzothiophene | 10140 |
| Dibenzothiophene | 0 |
| Beta-substituted dibenzothiophene | 1324 |
| Non-beta substituted dibenzothiophene | 1536 |
| TOTAL | 13,000 |

TABLE VIII

| LIQUID HOURLY SPACE VELOCITY NEEDED TO ACHIEVE 90% DESULFURIZATION | | |
|---|---|---|
| Catalyst Configuration | Feed A | Feed B |
| Catalysts 1 + 2 (series) | 1.08 | 3.29 |
| Catalysts 1 + 2 (staged) | 1.73 | 4.45 |

TABLE VIII-continued

| LIQUID HOURLY SPACE VELOCITY NEEDED TO ACHIEVE 90% DESULFURIZATION | | |
|---|---|---|
| Catalyst Configuration | Feed A | Feed B |
| Advantage (staged/series) | 1.60 | 1.35 |

As can be seen from the simulated experiments, based upon calculated results, the staged catalyst configuration would be expected to have a greater advantage than use of catalysts in series when the more difficult to desulfurize feed (feed A) is used. The advantage would be expected to be about 19% greater than the desulfurization obtainable on virgin feedstock B.

What is claimed is:

1. A two-stage hydrorefining process which comprises:

(a) contacting a sulfur-containing heavy hydrocarbonaceous oil feed comprising at least about 0.30 wt. % of an organic sulfur compound selected from the group consisting of dibenzothiophene, dibenzothiophene derivatives, substituted dibenzothiophene and mixtures thereof, with hydrogen in the presence of a nickel-containing hydrorefining catalyst in a first hydrorefining stage maintained at hydrorefining conditions, including a temperature ranging from about 600° to 850° F. and a total pressure ranging from about 60 to 3500 psig, to produce a first hydrorefining stage effluent, including a partially hydrodesulfurized oil, hydrogen sulfide and ammonia;

(b) removing at least a portion of said hydrogen sulfide and said ammonia from said first hydrorefining stage effluent;

(c) contacting at least a portion of the resulting hydrorefining stage effluent, including said partially hydrodesulfurized oil, with hydrogen in the presence of a cobalt-containing hydrorefining catalyst in a second hydrorefining stage to produce a hydrocarbonaceous oil having a lower sulfur content than the sulfur content of the partially desulfurized oil of said first hydrorefining stage, and (d) recovering a hydrorefined oil having a lower content of said organic sulfur compound than said oil feed of step (a).

2. The process of claim 1 wherein said heavy oil has an atmospheric pressure boiling point above about 350° F.

3. The process of claim 1 wherein said heavy hydrocarbonaceous oil is selected from the group consisting of gas oils derived from cracking processes.

4. The process of claim 1 wherein said gaseous product is separated from said normally liquid product and wherein said normally liquid product is passed to said second stage hydrorefining.

5. The process of claim 1 wherein said second stage conditions include a total pressure ranging from about 60 to 3500 psig and a temperature ranging from about 600° to 850° F.

6. The process of claim 1 wherein said nickel-containing catalyst in said first stage comprises at least one nickel component selected from the group consisting of elemental nickel, nickel oxide and nickel sulfide and mixtures thereof and at least one molybdenum component selected from the group consisting of elemental molybdenum, molybdenum oxide, molybdenum sulfide and mixtures thereof and an alumina support.

7. The process of claim 1 wherein said cobalt-containing catalyst comprises a cobalt component selected from the group consisting of elemental cobalt, cobalt oxide, cobalt sulfide and mixtures thereof and at least one molybdenum component selected from the group consisting of elemental molybdenum, molybdenum oxide, molybdenum sulfide and mixtures thereof and an alumina support.

8. The process of claim 6 or claim 7 wherein said alumina support additionally comprises silica.

9. The process of claim 1 wherein said organic sulfur compound comprises a beta-substituted benzothiophene.

10. The process of claim 1 wherein said heavy hydrocarbonaceous oil feed has a boiling point above about 400° F. at atmospheric pressure.

11. The process of claim 1 wherein said heavy hydrocarbonaceous oil feed comprises at least 0.75 weight percent of said organic sulfur compound.

* * * * *